US005160583A

United States Patent [19]

Eaton et al.

[11] Patent Number: 5,160,583

[45] Date of Patent: Nov. 3, 1992

[54] CONTROLLED JET INJECTION APPARATUS FOR A PAPERMAKING MACHINE HEADBOX

[75] Inventors: Daniel J. Eaton; Roger A. Kanitz, both of Beloit, Wis.

[73] Assignee: Beloit Corporation, Beloit, Wis.

[21] Appl. No.: 801,283

[22] Filed: Dec. 2, 1991

[51] Int. Cl.[5] ..... D21F 1/00

[52] U.S. Cl. ..... 162/301; 162/317; 162/344; 162/347; 162/214

[58] Field of Search ..... 162/203, 212, 214, 301, 162/317, 344, 347, 336

[56] References Cited

U.S. PATENT DOCUMENTS

| | | | |
|---|---|---|---|
| 1,481,163 | 1/1924 | Van De Carr, Jr. . | |
| 3,010,510 | 11/1961 | Cirrito | 162/344 |
| 3,224,928 | 12/1965 | Lee et al. | 162/203 |
| 3,440,136 | 4/1969 | Nelson et al. | 162/203 |
| 3,450,596 | 6/1969 | Green | 162/344 |
| 3,619,362 | 11/1971 | Parker | 162/203 |
| 3,823,064 | 7/1974 | Ward | 162/301 |
| 3,832,282 | 8/1974 | Parker | 162/203 |
| 3,839,149 | 10/1974 | Justus et al. | 162/317 |
| 3,855,057 | 12/1974 | Hill | 162/303 |
| 4,024,016 | 5/1977 | Gordon | 162/347 |
| 4,124,441 | 11/1978 | Nykopp | 162/301 |
| 4,153,504 | 5/1979 | Justus | 162/306 |
| 4,216,056 | 8/1980 | Nykopp | 162/300 |
| 4,505,779 | 3/1985 | Boissevain | 162/199 |
| 4,517,055 | 5/1985 | Dove | 162/344 |
| 4,517,056 | 5/1985 | Roerig et al. | 162/344 |
| 4,609,435 | 9/1986 | Tissari | 162/203 |
| 5,084,138 | 1/1992 | Ewald | 162/301 |

*Primary Examiner*—Karen M. Hastings

*Attorney, Agent, or Firm*—Dirk J. Veneman; Raymond W. Campbell; Gerald A. Mathews

[57] ABSTRACT

In a papermaking machine, a method and mechanism for delivering stock to a dewatering web including a pressure headbox with a narrowing slice opening, a receiving throat either with a single traveling forming wire or a pair of traveling forming wires, bridging the space between the headbox opening and the wire so that the stock jet is contained without a free surface, and applying a trailing flexible element opposite the stock in a single wire machine or against one wire in a twin wire machine with the force and location of the trailing element controlled by a series of push rods arranged parallel in a cross machine direction.

3 Claims, 2 Drawing Sheets

CONTROLLED JET INJECTION APPARATUS FOR A PAPERMAKING MACHINE HEADBOX

BACKGROUND OF THE INVENTION

The present invention relates to improvements in papermaking machines and more specifically to a headbox and forming zone arrangement for delivering a controlled flow of stock to a forming zone.

Developments in the papermaking field relative to delivering a jet of stock from a pressure headbox to a forming zone have included improvements such as turning bars over which the wires are trained, vanes in the headbox and bladed forming zone arrangements which tend to eliminate the need for a free jet of stock. The headbox and former become a single unit with the ability to totally control the activity of the approached flow of stock without free surface instability. Limitations to the development of sheet quality, particularly where multiple layers are required, exist in the free jet which has heretofore been controlled by a profiling bar or slice lip.

In multiple layered paper, good layer purity has been limited by the control restrictions to permit a headbox jet to pass through free air until it has been placed under control by the forming zone. Excess activity of the free jet causes the jet to break up. The need for a protruding slice bar causes discharge vortexes which generate layer mixing.

FEATURES OF THE INVENTION

An object of the invention is to provide an improved stock delivery apparatus and method for delivery of a stock jet from a pressure headbox to a forming zone which is particularly well adapted to the formation of multilayered paper and achieves improved layer purity.

A further object of the invention is to provide an improved arrangement in a papermaking machine which eliminates the need for a free jet between the headbox and the traveling wires.

The arrangement of the invention eliminates the need for free jet surfaces and the disturbance of the slice lip. Headbox sheet activity layer separation in presently available arrangements can be extended beyond the traditional headbox and even into the early portion of the forming zone. In the present arrangement, the heavy structural demands of the typical conformable slice lip are replaced with a flexible strip which maintains the weight profile simply by changing the channel thickness. The arrangement recognizes that pondside sealing is required until the jet has achieved wire velocity. The improved arrangement is capable of adaptability to a fourdrinier style machine using a single wire or to a twin wire machine.

Headboxes of the type heretofore available are changed in that slice profiling jacks and fingers are eliminated. A bridging arrangement is provided which eliminates the free surface and removes water spray and surface fibers. In a preferred arrangement, the wires pass over turning bars which guide the wires into a forming zone. The headbox jet is protected from free air surface with sealing strips that seal against the wires preventing fiber buildups and jet surface expansions. The cross channel thickness is controlled by the relative position of the turning bars. The cross machine channel thickness is developed with a flexible trailing lip which is hinged from one side of the forming zone and is adjusted for profile control. The flexible trailing lip is controlled by a plurality of parallel rods extending into abutment with the trailing lip.

Other objects, advantages and features of the invention will become more apparent with the teachings of the principles of the invention in connection with the disclosure of the preferred embodiments in the specification, claims and drawings, in which:

EMBODIMENTS OF THE INVENTION

Figure 1:
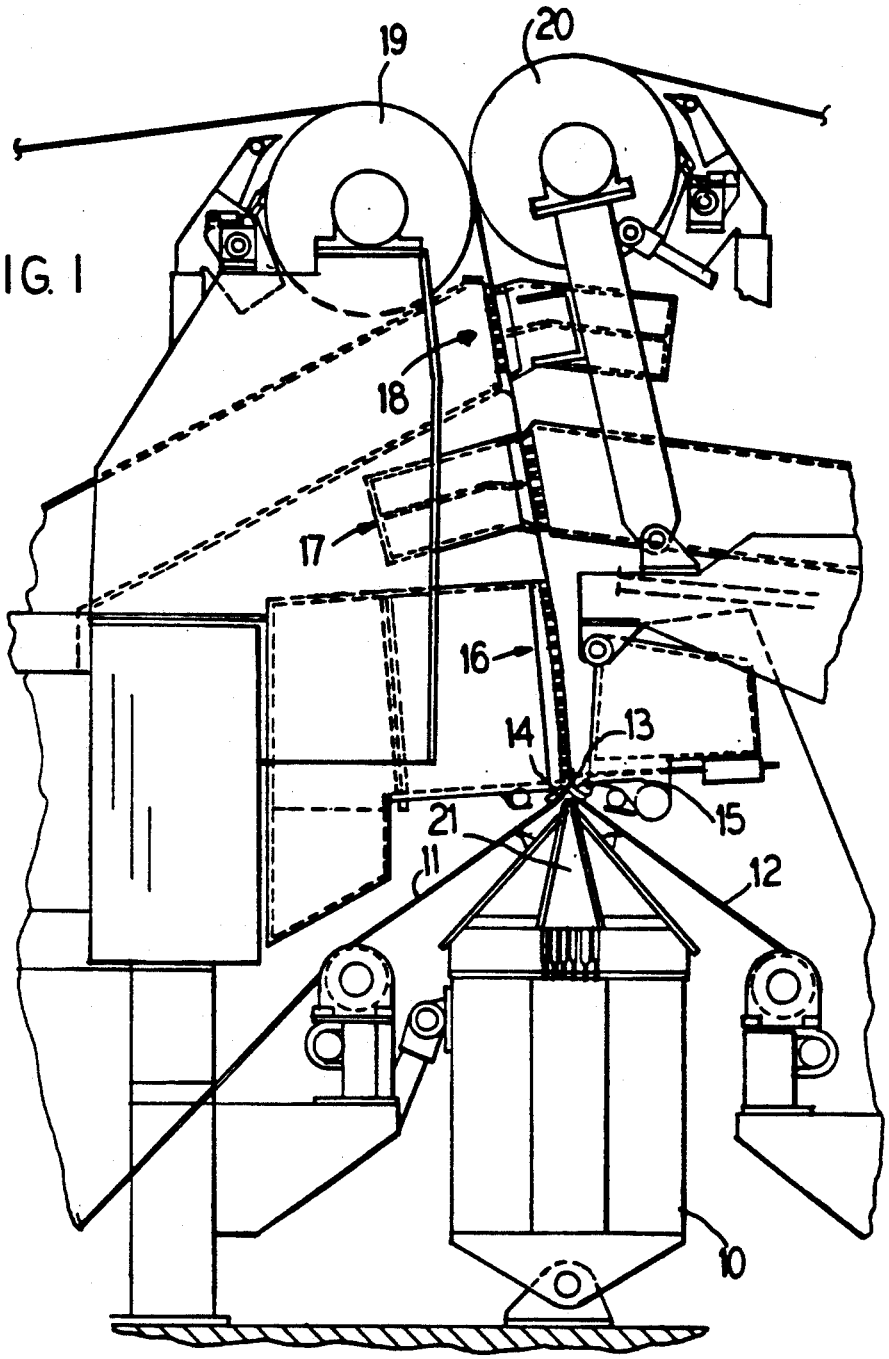
FIG. 1 is an elevational view shown somewhat in schematic form of an overall forming section of a papermaking machine of the type utilizing and embodying the principles of the present invention.

As illustrated in FIG. 1, an overall twin wire forming section is shown of the type where the wires travel generally vertically. The principles of the invention can be employed in various single wire or twin wire machines as will become apparent with the disclosure of the various embodiments and structural features.

Stock is delivered from a pressure headbox 10 which has a tapering slice 21 in substantial alignment with a forming throat 13. The forming throat is formed between twin looped traveling wires 11 and 12 which travel upwardly and as stock is delivered between the wires, it is dewatered and the web formed by successive dewatering apparatus shown at 16, 17 and 18. The twin wires are then separated by turning couch rolls 19 and 20.

Figure 3:
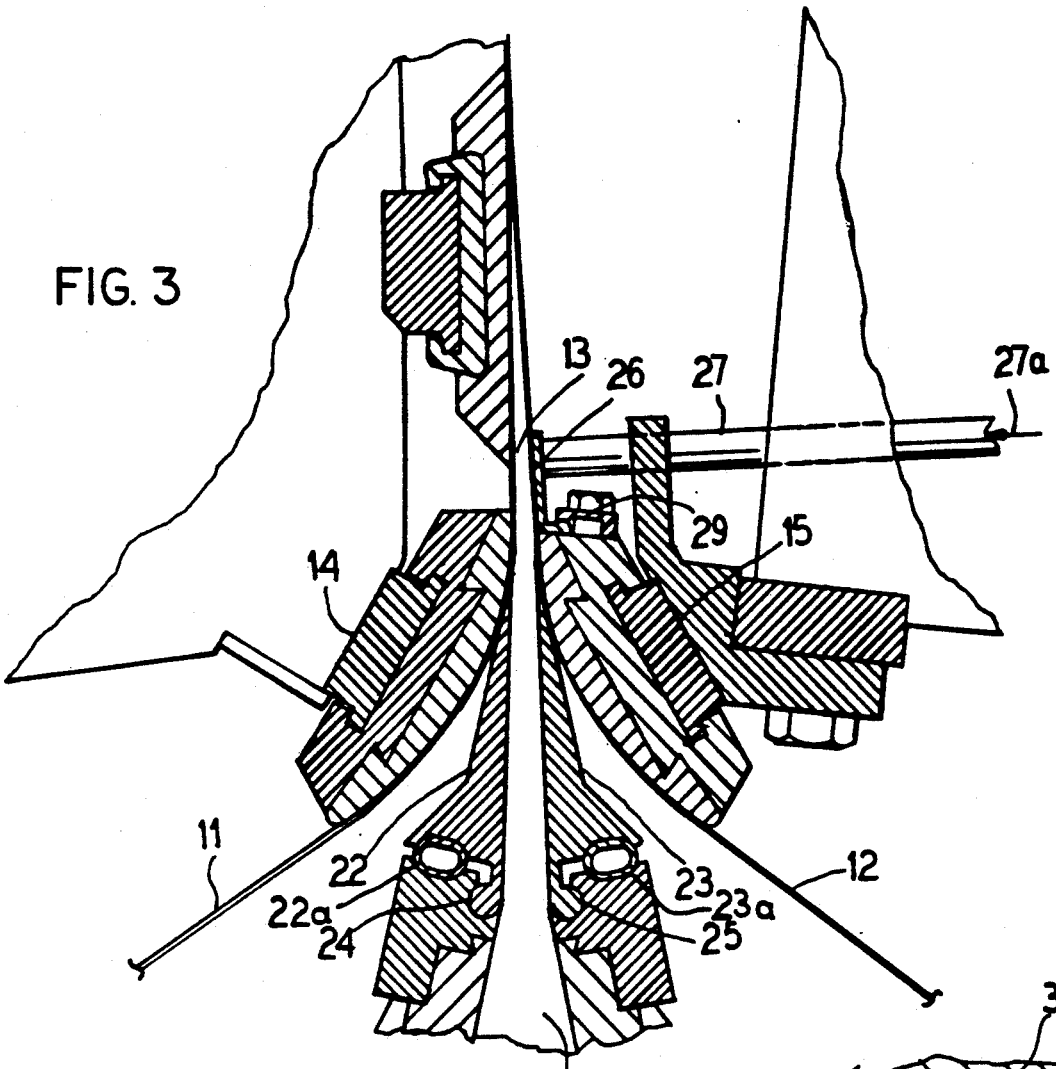
FIG. 3 is a sectional view illustrating the throat of a forming section of a papermaking machine.

As shown in more detail in FIG. 3, the twin wires 11 and 12 pass over curved turning bars 14 and 15 to be guided to form a throat 13. Stock under pressure flows from the pressure headbox into the tapered slice opening 21.

Figure 2:
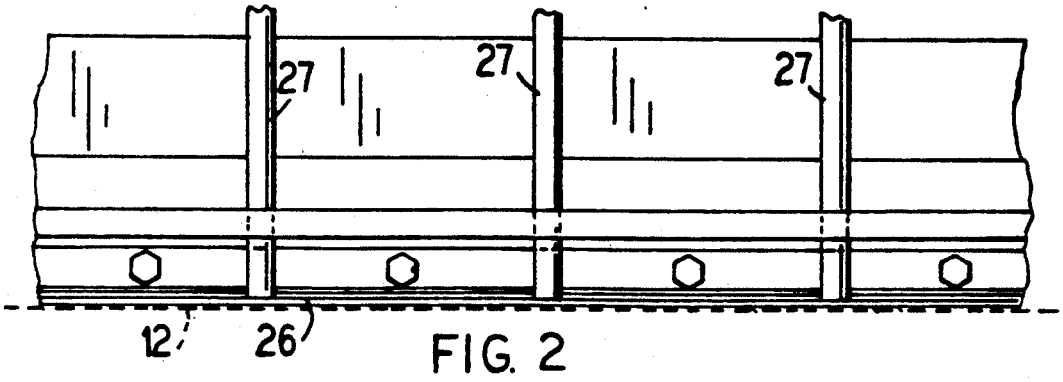
FIG. 2 is an enlarged fragmentary view of a portion of the lip apparatus for controlling the flow of stock into the forming zone.

Bridging elements 22 and 23 are provided at the slice opening bridging the space between the opening 21 in the throat 13 so that the stock flowing therethrough is under full control and has no free surfaces in passing into the throat 13. The bridging elements 22 and 23 are tapered with the tapered fine edges in close running relationship to the wires 11 and 12. The bridging elements are pivotally attached to the headbox at 24 and 25. As the stock enters the throat, the size of the throat is controlled by the relative position of the turning bars which adjusts the jet velocity relative to wire speed. Air tubes **22*a* and 23*a* are provided to relieve bridging element loading on the wires. Cross machine weight profiling can be controlled by a pressure element preferably in the form of a flexible trailing slice lip 26. The trailing slice lip may be of flexible material such as rubber or plastic and is in engagement with the undersurface of the wire 12. Control pressure is applied along the length of the slice lip 26 in a cross machine direction by a plurality of parallel rods 27 by power elements (not shown) indicated schematically by the arrowed line 27*a*. These rods are shown in greater detail in FIG. 2 and force mechanisms are attached to each of the rods to apply throat control force to the trailing lip 26. As shown in FIG. 3, the trailing lip 26 is supported and mounted at 29 on the turning bar 15**.

Figure 4:
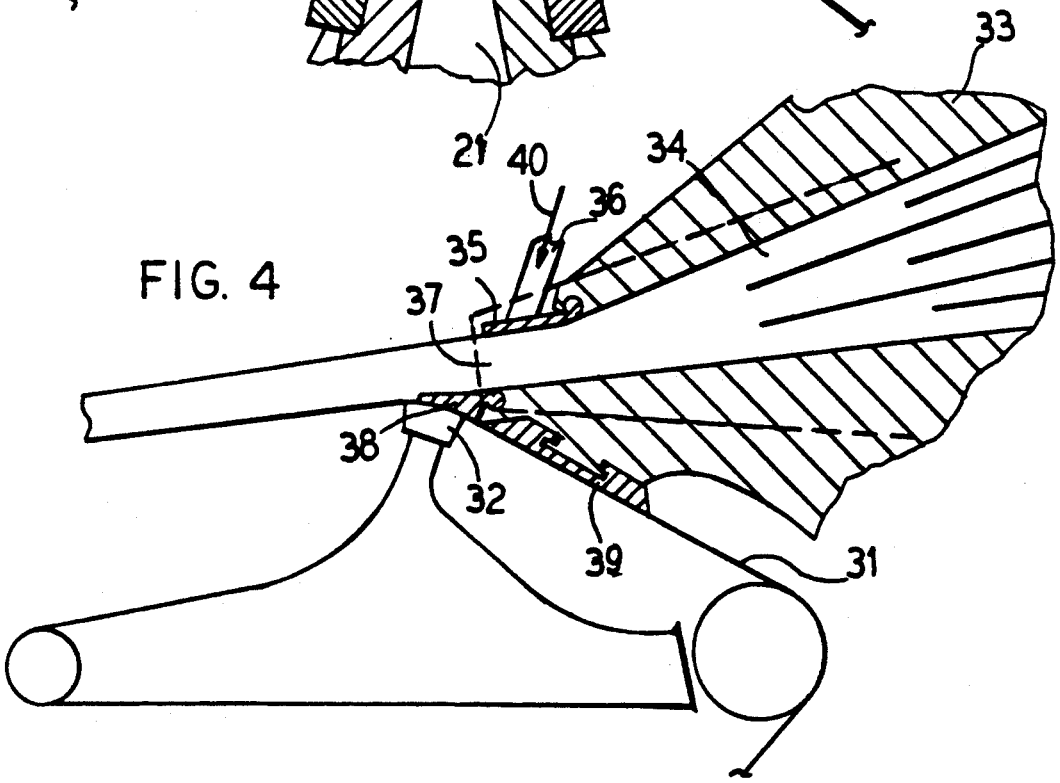
FIG. 4 is a somewhat schematic sectional view illustrating the principles of the invention as applied to a single forming wire in a fourdrinier machine.

FIG. 4 illustrates the principles applied to a fourdrinier machine which has a single looped traveling wire 31. The wire is trained over a curved turning bar 32. Stock is delivered from a headbox 33 which has a tapered chamber 34 leading to a slice opening 37. The headbox is designed so that it has a bridging element 38 which is tapered and in close sliding adjacency to the top surface of the wire 31. A shoe 39 stabilizes the wire as it enters a forming throat area 37. At the upper side of the throat opening 34 is a flexible trailing slice lip 35. The slice lip is pivotally hinged on the headbox and its position is controlled by a series of parallel rods 36 spaced and arranged in a cross machine direction. Force elements as shown schematically by the arrowed line 40 control the position of the flexible trailing lip. Thus, as the stock emerges from the headbox, it has bottom side support and is delivered to the wire with less disruption. The size of the throat opening is controlled by the flexible trailing lip 35.

In operation, with reference to FIG. 3, stock under pressure is delivered by a headbox through a tapered opening 21 and flows under control with no free surfaces into a forming throat 13 by bridging elements 22 and 23. The bridging elements are in close running contact with the twin wires 11 and 12. The size of the throat and the flow is further controlled by a trailing flexible slice lip 26 extending downstream along forming wire 12 so that at all times the stock flow jet is under control and has no free surfaces. When layered stock is handled, the layer integrity remains intact and intermixing is minimized.

Thus, it will be seen there has been provided an improved stock flow control from the headbox to the forming zone which meets the objectives and advantages above set forth and provides a simplified control which is particularly well adapted to high speed production papermaking equipment.

I claim as my invention:

1. In a papermaking machine, a mechanism for delivering stock to a dewatering web forming zone comprising, in combination:

a pressure headbox for containing stock and having pondside sealing, and a narrowing slice opening;

opposed traveling foraminous forming surfaces comprising twin looped forming wires providing a throat in substantial alignment with the slice opening;

means bridging the spaces between the opening and the forming surfaces so that a stock jet is contained in movement from the opening to the forming surface absent a free surface of the stock;

and control means for controlling the space between said forming surfaces in the throat, the control means including a flexible trailing slice lip structured and arranged to control cross machine weight profile and in engagement with the underside of one of the opposed traveling forming surfaces.

2. In a papermaking machine, a mechanism for delivering stock to a dewatering web forming zone comprising, in combination:

a pressure headbox having pondside sealing for containing stock and having a narrow slice opening;

and a pair of looped traveling forming wires moving in close adjacency to the slice opening over respective turning bars; means bridging the spaces between the opening and the forming wires so that a stock jet is contained in movement from the opening to the forming wires absent a free surface of the stock; and a trailing flexible slice lip mounted on one of said turning bars and in engagement with the inside of one of the looped forming wires with means for adjusting the force of said slice lip against the wire to control the throat opening and cross machine weight profile.

3. In a papermaking machine, a mechanism for delivering stock to a dewatering web forming zone comprising, in combination:

a pressure headbox for containing stock and having pond side sealing and a narrowing slice opening;

opposed traveling foraminous forming surfaces comprising twin looped forming wires providing a throat in substantial alignment with he slice opening;

means bridging the spaces between the opening and the forming surfaces so that a stock jet is contained in movement from the opening to the forming surface absent a free surface of the stock;

control means, including a flexible trailing slice lip in engagement with the inside of one of said looped forming wires extending in a cross-machine direction;

a plurality of elongate rods extending parallel to each other and in engagement with the flexible trailing slice lip, and individually adjustable to control the local deflection of the trailing slice lip.

* * * * *